US006893186B1

(12) United States Patent
Tello, Sr.

(10) Patent No.: US 6,893,186 B1
(45) Date of Patent: May 17, 2005

(54) MANHOLE COVER

(76) Inventor: Steve Tello, Sr., 2019 Dayflower Trace, Cedar Park, TX (US) 78613

( * ) Notice: Subject to any disclaimer, the term of this patent is extended or adjusted under 35 U.S.C. 154(b) by 0 days.

(21) Appl. No.: 10/636,870

(22) Filed: Aug. 7, 2003

Related U.S. Application Data

(60) Provisional application No. 60/401,841, filed on Aug. 7, 2002.

(51) Int. Cl.[7] ..... E02D 29/14
(52) U.S. Cl. ..... 404/25; 52/19
(58) Field of Search ..... 404/25, 26; 52/20, 52/21, 19; 277/355; 220/216

(56) References Cited

U.S. PATENT DOCUMENTS 4,492,095 A * 1/1985 Brister ..... 62/293
4,551,577 A * 11/1985 Byrne ..... 174/57
5,052,851 A * 10/1991 Frishauf ..... 404/25
5,176,389 A * 1/1993 Noone et al. ..... 277/355
5,507,600 A * 4/1996 Takahashi ..... 405/303
5,842,811 A * 12/1998 Johnson ..... 404/25
6,018,914 A * 2/2000 Kamiyama et al. ..... 52/20
2004/0016755 A1 * 1/2004 Gilbert et al. ..... 200/216

* cited by examiner

*Primary Examiner*—Thomas B. Will
*Assistant Examiner*—Raymond W Addie
(74) *Attorney, Agent, or Firm*—Kenneth L Tolar

(57) ABSTRACT

A temporary manhole cover for protecting workers purging a sewer line from splattering waste includes a substantially circular cover member having an outer rim bordering a central indented portion. The indented portion is transparent allowing the worker to observe the manhole interior if necessary. The cover member includes an elongated opening radially extending from the center of the indented portion to the outer edge of the rim. Disposed within the opening are a plurality of horizontal contiguous bristles. A water hose may be inserted into a manhole when the cover is properly installed by inserting the hose through the opening. The bristles retain the hose in a select position while retaining sewage within the manhole.

6 Claims, 2 Drawing Sheets

MANHOLE COVER

CROSS REFERENCE TO RELATED APPLICATIONS

This application is entitled to the benefit of provisional application No. 60/401,841 filed on Aug. 7, 2002.

BACKGROUND OF THE INVENTION

The present invention relates to a manhole cover, specifically, a cover designed to temporarily cover a manhole while a sewer system is being flushed, to minimize splashing of sewage or waste.

DESCRIPTION OF THE PRIOR ART

Manholes found on many public roadways provide selective access to municipal sewer systems. Typically, such manholes are enclosed with heavy-duty covers designed to withstand vehicle traffic. Periodically, the municipal sewer systems must be purged to remove blockage therein. Usually, purging is accomplished by removing the cover and inserting an industrial type water hose into the manhole to flush the system with pressurized water.

However, directing pressurized water through an open manhole typically results in significant splatter of sewage in the area immediately surrounding the manhole. Accordingly, such activity exposes workers and others in the nearby area to significant health risks associated with raw sewage such as Hepatitis and *E. Coli* bacteria.

The present invention satisfies the above-enumerated problems by providing a temporary cover that may be placed over a manhole through which a hose can be inserted while retaining sewage and other waste within the manhole.

SUMMARY OF THE INVENTION

The present invention relates to a manhole cover that retains waste within a manhole while allowing workers to insert a cleaning hose therethrough. The device includes a substantially circular cover member dimensioned and configured to substantially conform to a manhole opening so as to securely and tightly fit therein. The cover member includes a substantially circular outer rim peripherally bordering a central indented portion. Positioned on the outer rim are a pair of diametrically opposed handles for assisting a user in properly installing and removing the cover member. The indented portion of the cover member is preferably transparent allowing a worker to see therethrough. An elongated opening radially extends from the center of the indented portion to the outer edge of the rim. Disposed within the opening are a plurality of contiguous, horizontal bristles through which a water hose may be inserted thereby providing access to the manhole while the cover is installed thereon. Furthermore, the bristles also prevent waste from exiting the manhole and assist in retaining the water hose at a desired position.

It is therefore an object of the present invention to provide a manhole cover that protects nearby workers from splattering sewage and waste.

It is another object of the present invention to provide a manhole cover that minimizes health and safety risks associated with purging clogged sewer lines.

It is yet another object of the present invention to provide a manhole cover that is easy to use and inexpensive to manufacture.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
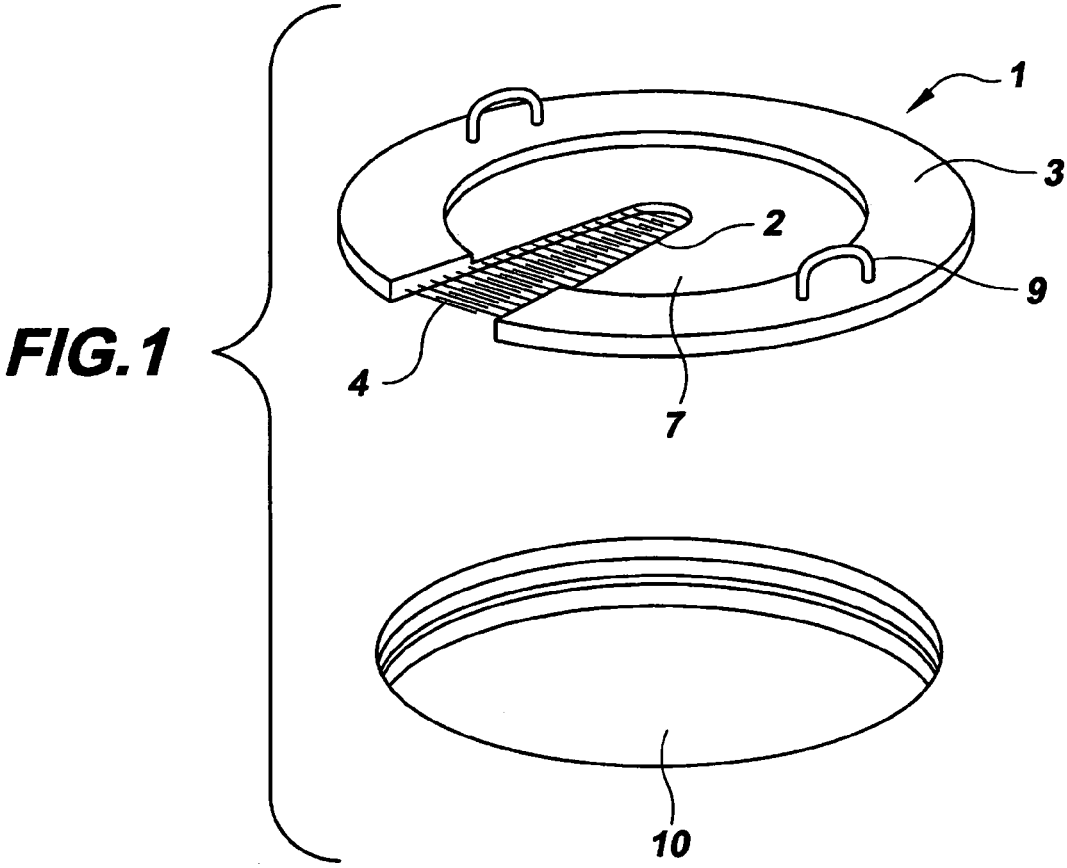
FIG. 1 is a perspective view of the manhole cover according to the present invention superimposed on a manhole.
Figure 2:
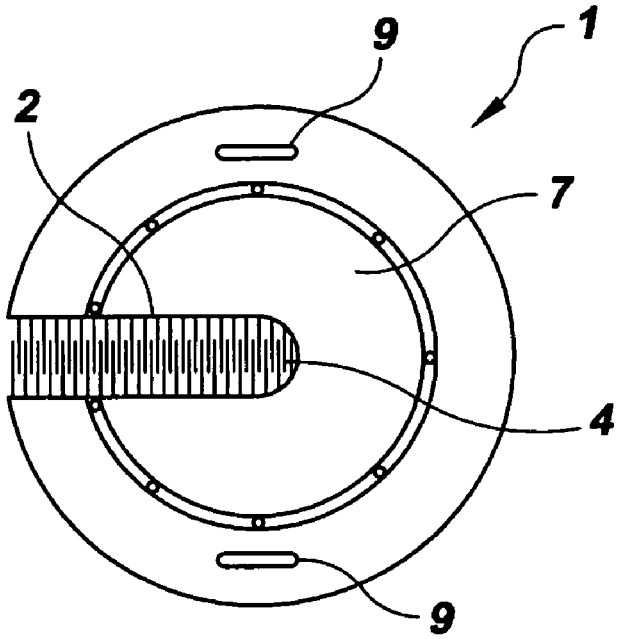
FIG. 2 is a top view of the manhole cover.
Figure 3:
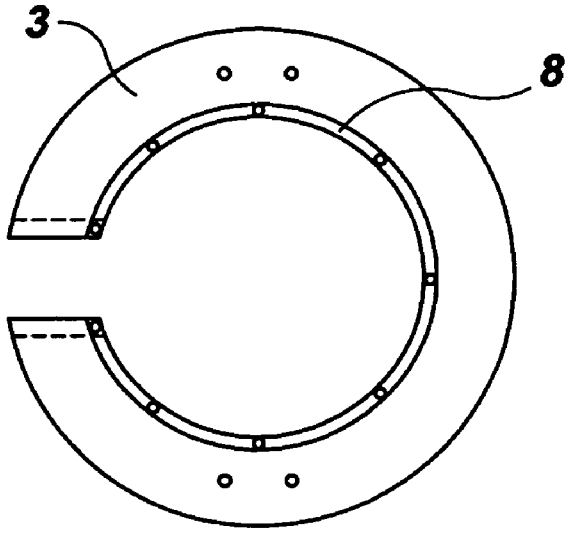
FIG. 3 is a lower view of the cover member circular outer rim.

The present invention relates to a temporary manhole cover that retains waste within the manhole while allowing a cleaning hose to be inserted therein. The device includes a substantially circular cover member 1 dimensioned and configured to substantially conform to a manhole opening 10 so as to securely and tightly fit therein. The cover member includes a substantially circular outer rim 3 peripherally bordering an indented portion 7. The indented portion of the cover member is preferably transparent allowing a worker to observe the manhole interior if desired. The rim is secured to the indented portion using conventional means or fasteners. Preferably, a gasket 8 is positioned between the joint of the indented portion and outer rim to minimize moisture intrusion or seepage. Disposed on the outer rim are a pair of diametrically opposed handles 9 for assisting a user in properly installing and removing the cover member.

An elongated opening 2 radially extends from the center of the indented portion to the outer edge of the rim. Horizontally disposed within the opening are a plurality of contiguous, intermeshing bristles 4 through which a water hose may be inserted thereby providing selective access to the manhole while the cover is installed thereon. Furthermore, the bristles also retain waste within the manhole while retaining the water hose at a desired position. Preferably, the bristles are multi-tiered so as to provide a tight, impermeable barrier around the hose.

As is now readily apparent, the present invention provides a temporary manhole cover that allows a hose to be inserted into the manhole while preventing waste from escaping. The device is not to be limited to the exact details and arrangement of parts as described above. The circular rim is preferably constructed with cast aluminum or a similar metal while the indented portion is constructed with polycarbonate plastic or equivalent. However, the size, shape and materials of construction of the various components can be varied to suit a particular application.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A manhole cover comprising:

a cover member dimensioned and configured to tightly conform to a manhole;

an elongated opening radially extending from a substantially central portion of said cover member to a peripheral edge thereof;

a plurality of contiguous, intermeshing bristles horizontally disposed within said opening.

2. The manhole cover according to claim 1 wherein said cover includes a transparent indented portion for allowing a worker to see into a manhole while the cover member is superimposed thereon.

3. The manhole cover according to claim 2 wherein said bristles are multi-tiered to tightly retain a hose within said opening.

4. The manhole cover according to claim 3 further comprising a rim peripherally bordering said indented portion.

5. The manhole cover according to claim 4 further comprising a pair of diametrically opposed handles positioned on said rim for grasping by a user to install and remove said cover.

6. The manhole cover according to claim 5 further comprising an outer rim circumscribing said indented portion with a gasket therebetween for providing a liquid impermeable seal between said cover member and a manhole.

* * * * *